US008201604B2

(12) United States Patent
Green et al.

(10) Patent No.: US 8,201,604 B2
(45) Date of Patent: Jun. 19, 2012

(54) SOLENOID DRIVEN APPLICATION MECHANISM

(75) Inventors: Timothy J. Green, North Tonawanda, NY (US); Joseph M. Fisher, Cheektowaga, NY (US); William B. Elliott, Alden, NY (US); Joseph J. Alfieri, Orchard Park, NY (US); Eric K. Spina, Eden, NY (US)

(73) Assignee: Illinois Tool Works Inc., Glenview, IL (US)

( * ) Notice: Subject to any disclaimer, the term of this patent is extended or adjusted under 35 U.S.C. 154(b) by 41 days.

(21) Appl. No.: 12/837,938

(22) Filed: Jul. 16, 2010

(65) Prior Publication Data

US 2011/0024018 A1 Feb. 3, 2011

Related U.S. Application Data

(60) Provisional application No. 61/230,896, filed on Aug. 3, 2009.

(51) Int. Cl.
*G05G 15/00* (2006.01)

(52) U.S. Cl. ..... 156/351; 156/64; 156/230; 156/360; 156/362; 156/363; 156/367; 156/378; 156/379; 72/3; 72/14.8; 72/43; 72/75; 72/125; 72/297; 72/307; 72/324; 72/379.2; 72/430; 72/447; 72/453.02; 72/453.03; 72/454; 72/455; 72/462; 72/464; 72/707

(58) Field of Classification Search ..... 156/64, 156/230, 351, 360, 362, 363, 367, 378, 379; 72/324, 464, 454, 455, 430, 707, 453.02, 72/453.03, 3, 14.8, 43, 75, 125, 297, 379.2, 72/462, 307, 447

See application file for complete search history.

(56) References Cited

U.S. PATENT DOCUMENTS

| | | | | |
|---|---|---|---|---|
| 4,265,355 | A | 5/1981 | Davis | |
| 4,969,305 | A | 11/1990 | York et al. | |
| 5,168,883 | A | 12/1992 | Winn | |
| 5,657,855 | A | 8/1997 | Ferguson | |
| 7,371,298 | B2 | 5/2008 | Michalski et al. | |
| 7,437,860 | B2 | 10/2008 | Brandow et al. | |
| 7,467,535 | B2 * | 12/2008 | Kuno et al. | 72/446 |
| 7,506,485 | B2 | 3/2009 | Quinn et al. | |
| 2003/0116285 | A1 | 6/2003 | Michalski et al. | |
| 2004/0045660 | A1 | 3/2004 | Chojnacki | |
| 2004/0045676 | A1 | 3/2004 | Chojnacki | |
| 2007/0214745 | A1 | 9/2007 | Quinn et al. | |
| 2007/0215261 | A1 | 9/2007 | Quinn et al. | |
| 2007/0215263 | A1 | 9/2007 | Quinn et al. | |
| 2008/0060320 | A1 | 3/2008 | Quinn et al. | |

* cited by examiner

*Primary Examiner* — Kat Wyrozebski
*Assistant Examiner* — Joshel Rivera
(74) *Attorney, Agent, or Firm* — Leydig, Voit & Mayer, Ltd.

(57) ABSTRACT

An apparatus for applying labels to products includes a label application station at which the labels are applied to a product and an application head movably mounted relative to a base for movement between a first operative loading position spaced from the label application station and a second operative application position at which the application head applies at least one label to a product positioned at the label application station. An electrically actuated solenoid is operatively connected to the application head to move the application head between the first and second operative positions.

17 Claims, 8 Drawing Sheets

SOLENOID DRIVEN APPLICATION MECHANISM

CROSS-REFERENCE TO RELATED APPLICATIONS

This patent application claims the benefit of U.S. Provisional Patent Application No. 61/230,896, filed Aug. 3, 2009, which is incorporated by reference.

BACKGROUND OF THE INVENTION

The present invention generally relates to an apparatus for applying labels to products and, more particularly, to a solenoid driven mechanism for applying labels to products.

Revenue or tax stamps must be applied to individual packs of cigarettes and, because the taxes and stamps vary by state, county and even by city, these stamps are typically not applied to the packs until they reach their final destination. For ease of handling, cigarette packs are packaged in the cartons in which they will ultimately be sold or displayed and the cartons are packaged in relatively large boxes that are shipped to the desired location.

The tax stamps are typically applied by a stamp head that uses a combination of heat and pressure to release the stamps from a carrier roll and deposit them on the individual cigarette packs. This tax stamping operation is usually performed at a distribution warehouse with automated equipment that is capable of applying stamps at rates of up to 120 cartons per minute. However, there are situations where the expense of high volume automation equipment cannot be justified such as low volume stamping operations, or situations in which technical issues exist due to the size of the packs or cartons or the orientation of the packs within the cartons. In such situations, the typical manner of applying tax stamps is to use a hand iron, which includes a stationary base with an iron positioned thereon, together with a tax stamp feed mechanism so as to provide and align tax stamps with the stationary iron.

In order to apply tax stamps with a stationary iron, a user aligns an open carton of cigarettes with the stationary iron and presses the cigarette carton against the stationary iron. The stationary iron applies the heat and the user applies the pressure in order to transfer the tax stamps from the tax stamp carrier roll to the individual packs within the carton. Unfortunately, such manual process often results in poor and inconsistent application of tax stamps to the packs as the manual process is highly dependent upon the skill level of the operator.

High volume automated systems for applying tax stamps typically include multiple stations for processing the cartons of cigarettes. The cartons are unloaded at a first station and individually transported and processed in an automated manner. The cartons move from a first station at which the cartons are opened to a tax stamp application station at which the stamps are applied and then the cartons are transported to a station at which the cartons are resealed and loaded into boxes for subsequent distribution. Automated application stations typically utilize one of two types of mechanisms for applying tax stamps. In one type, a pneumatic cylinder is used to drive the stamp head in a reciprocating manner. While the reliability or performance of pneumatic powered automation equipment is generally not an issue, such systems require the additional expense, maintenance and complexity of providing an air supply within a manufacturing environment. Accordingly, the use of pneumatic systems increases the initial expense and reduces the flexibility of a stamp application operation.

A second type of automated application system is electrically driven and uses a motor and a series of gears and cams drive the linear movement of the stamp head. Due to the complexity and functionality of the gear and cam mechanisms, the length of displacement or stroke of the electrically heated iron is relatively fixed for each set of gears and cams and the systems are generally expensive.

BRIEF SUMMARY OF THE INVENTION

Accordingly, it is an object to solve the above-described problems encountered with existing tax stamp application equipment by providing an electrical solenoid driven tax stamp application apparatus that may be used in either manual or with automated processing of cigarette packs. More specifically, it would be desirable to provide an apparatus for applying labels to products having a label application station at which the labels may be applied and an application head movably mounted on base for movement between a first operative position spaced from a product positioned at the label application station and a second operative position at which the application head applies a label to the product positioned at the label application station. A solenoid is operatively connected to the application head to move the application head between the first and second operative positions and an actuator mechanism provides a triggering signal to an electricity source upon a triggering event to actuate the solenoid and move the application head from the first operative position to the second operative position. A label feeding mechanism provides a supply of labels for application to the products.

If desired, the actuator mechanism may include a switch that is actuated upon engagement of the actuator mechanism by a force approximately equal to a force generated by actuation of the solenoid. The actuator mechanism may include a movable trip plate configured to be engaged by the product to actuate the switch. The actuator mechanism may include an electronic sensor for sensing a predetermined desired positioning of a product at the label application station.

If desired, a drive structure may interconnect the application head and the solenoid with the drive structure being configured to guide the application head along a linear path between the first and second operative positions. The drive structure may include a drive block operatively connected to the solenoid on a side of the solenoid opposite the application head and actuation of the solenoid may move the drive block towards the solenoid and the application head away from solenoid and towards the product located at the label application station. The drive structure may include a pair of spaced apart guide shafts positioned on opposite sides of the solenoid for guiding the application head along the linear path with the guide shafts being operatively connected to the drive block and the application head. A pair of return springs may be provided for assisting in moving the application head from the second operative position to the first operative position with each return spring being concentrically positioned relative to one of the guide shafts.

If desired, means may be provided for returning the application head from the second operative position to the first operative position. Such returning means may include at least one spring. The label may be applied to the product by applying heat to the label and pressure between the application head and the product. The label feeding mechanism may supply labels to an operative position between the first and second operative positions of the application head. The application head may be configured to removably receive any of a plurality of differently configured removable application irons to permit labels to be applied to the product in different arrays.

An apparatus for applying labels to products may include a label application station at which the labels are applied to a product and an application head movably mounted relative to the base for movement between a first operative loading position spaced from the label application station and a second operative application position at which the application head applies at least one label to a product positioned at the label application station. An electrically actuated solenoid is operatively connected to the application head to move the application head between the first and second operative positions.

If desired, an actuator mechanism may provide a triggering signal to an electricity source upon a triggering event to actuate the solenoid and move the application head from the first operative loading position to the second operative application position. A switch may be provided that is actuated upon engagement of the actuator mechanism by a force approximately equal to a force generated by actuation of the solenoid. The actuator mechanism may include a movable trip plate configured to be engaged by the product to actuate the switch. A drive structure may be provided interconnecting the application head and the solenoid and configured to guide the application head along a linear path between the first and second operative positions. The drive structure may include a pair of spaced apart guide shafts positioned on opposite sides of the solenoid for guiding the application head along the linear path.

A method of applying a label to a product may also be provided including providing a label application station at which labels may be applied to product, providing a plurality of labels, positioning at the application station a product having a plurality of surfaces in a desired orientation to present a desired one of the surfaces to the label application station, generating a triggering signal to designate positioning of the product at a desired, predetermined position at the label application station, and providing electrical current to a solenoid to move an application head from a first position spaced from the label application station to a second position at the label application station in order to engage the product with at least one label positioned between the application head and the product. The method may also include actuating a switch by movement of the product to apply at least a predetermined force to an actuator. The method may also include utilizing heat and pressure to secure the at least one label to the product.

BRIEF DESCRIPTION OF THE DRAWING(S)

Various other objects, features and advantages of the present invention will become more fully appreciated and better understood when considered in conjunction with the accompanying drawings, in which like-referenced characters designate the same or similar parts throughout the several views, wherein.

DETAILED DESCRIPTION OF THE PREFERRED EMBODIMENT

The following description is intended to convey the operation of exemplary embodiments of the invention to those skilled in the art. It will be appreciated that this description is intended to aid the reader, not limit the invention. As such, references to a feature or aspect of the invention are intended to describe the feature or aspect of the embodiment of the invention, not to imply that every embodiment of the invention must have the described characteristic.

Figure 1:
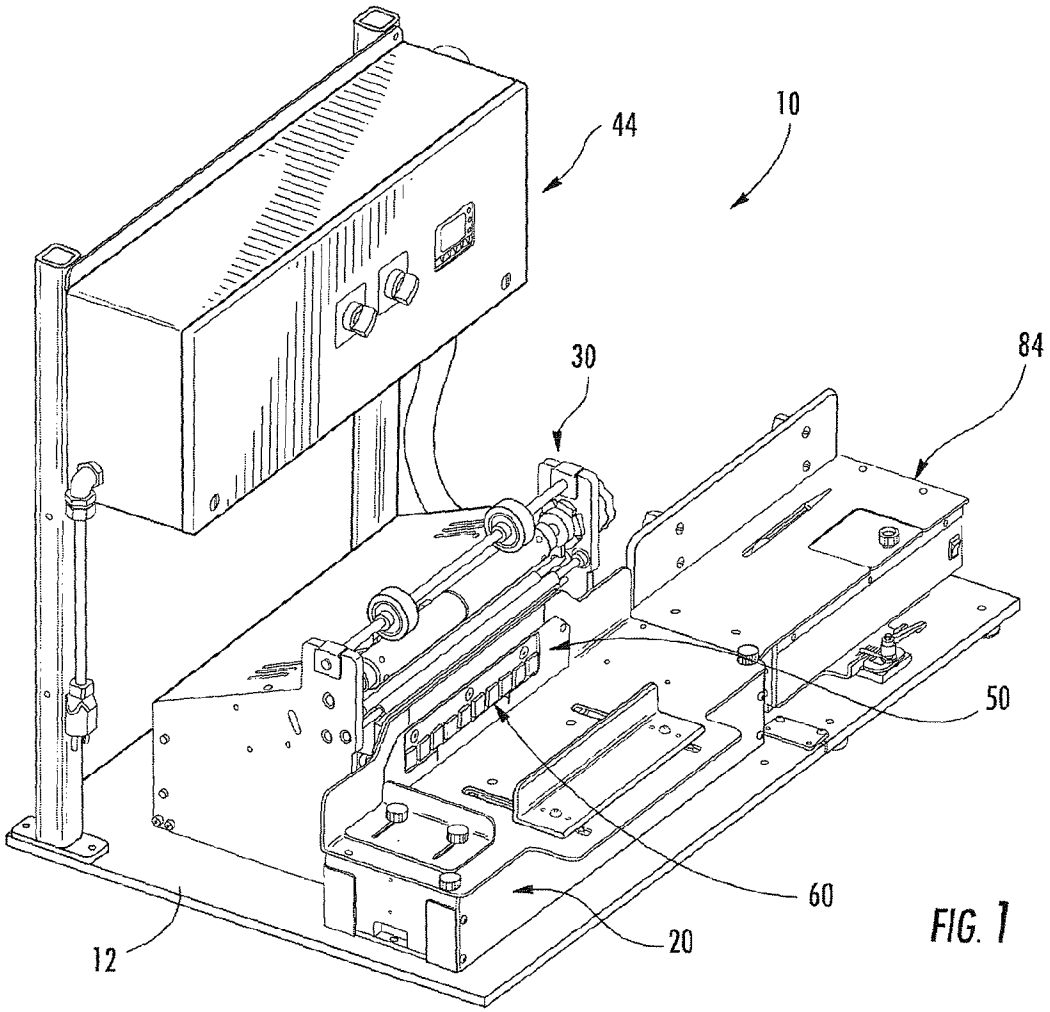
FIG. 1 is a perspective view of a manual revenue stamp application machine including the revenue stamp application mechanism of the present invention.
Figure 2:
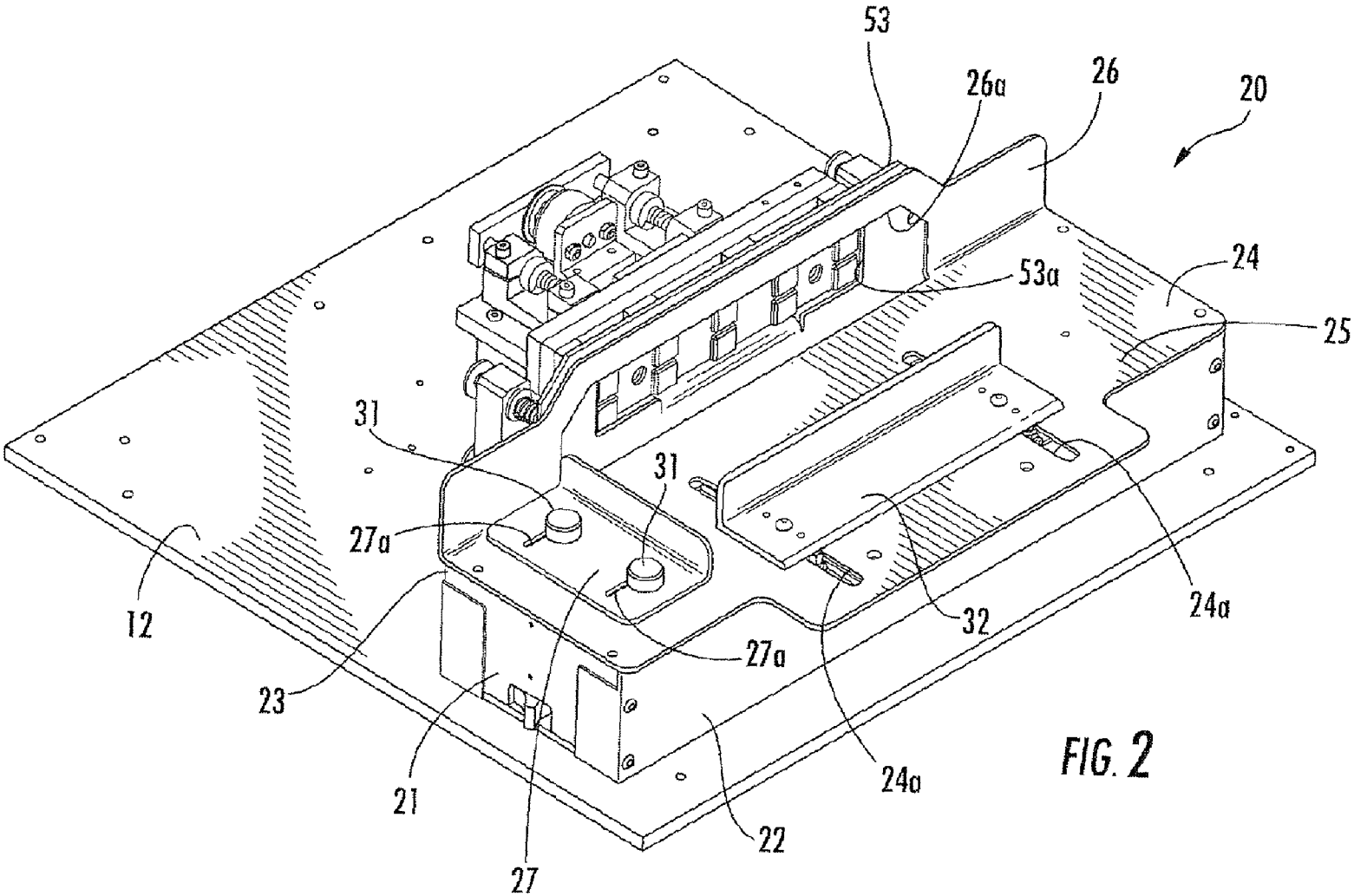
FIG. 2 is a perspective view of the carton positioning assembly, the actuator assembly and the revenue stamp application mechanism of FIG. 1.
Figure 3:
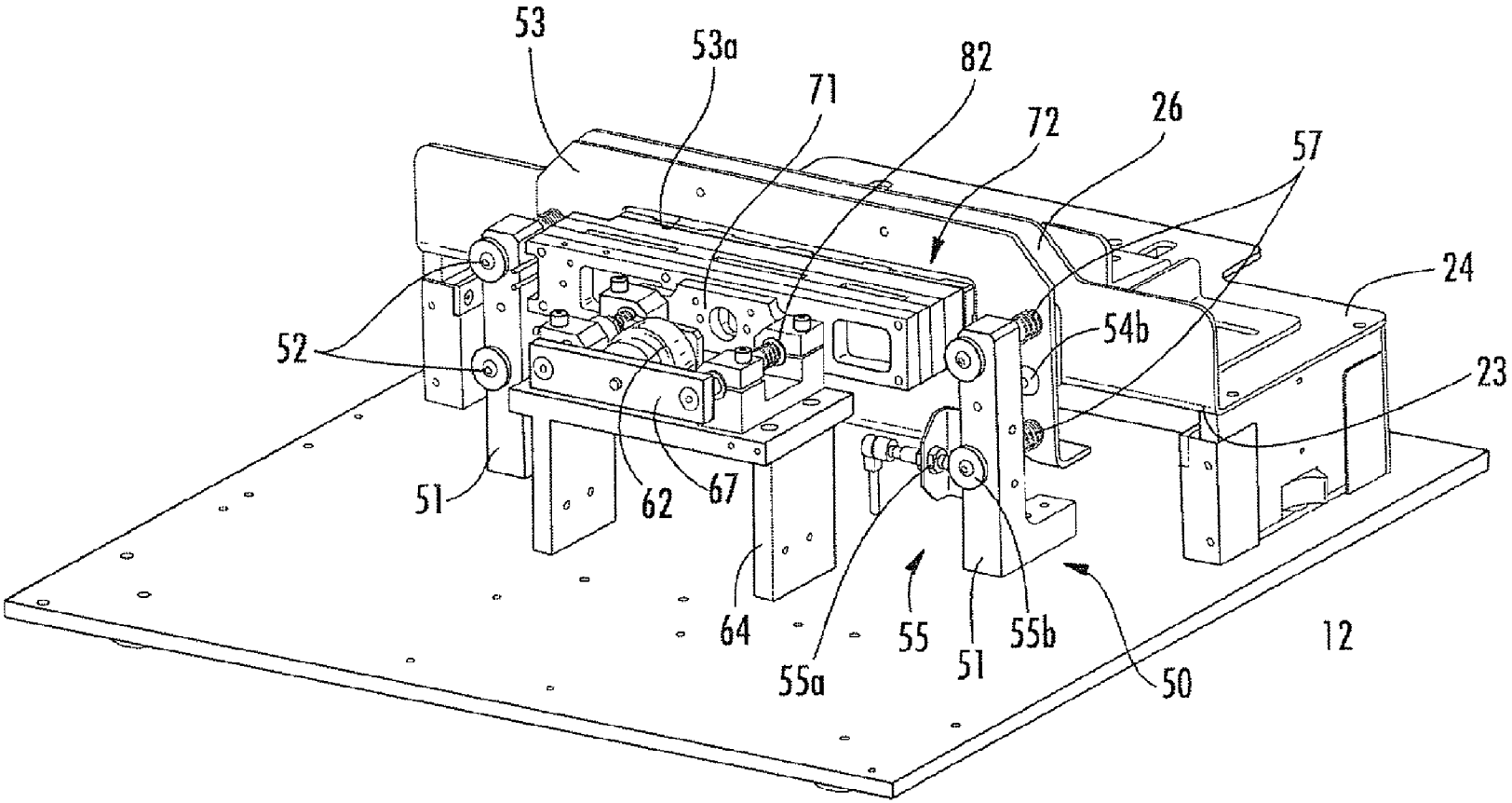
FIG. 3 is a rear perspective view of the carton positioning assembly, the actuator assembly and the revenue stamp application mechanism of FIG. 2.

Referring to FIG. 1, a semi-automatic apparatus 10 for applying revenue stamps to packs of cigarettes is shown. The revenue stamp applying apparatus 10 includes a base 12, a carton positioning assembly 20, a revenue stamp feed mechanism 30, a programmable controller assembly 44, an actuator assembly 50 and a revenue stamp application mechanism 60. If desired, an optional hot glue station 84 may also be provided. Carton positioning assembly 20 includes a pair of oppositely facing sidewalls 21 interconnecting oppositely facing front wall 22 and rear wall 23 to form a generally rectangular pedestal. A top plate 24 is positioned on top of the assembly formed by the two sidewalls 21 and the front wall 22. Top plate 24 includes a generally planar section 25 that is generally parallel to base 12 and a vertically upstanding guide plate 26 extending above a rear edge 23 of top plate 24. Guide plate 26 includes a generally rectangular aperture **26*a* through which carton 15 (shown in phantom in FIGS. 5-7) is slid during the revenue stamp application process. A horizontal carton alignment block 27 is generally L-shaped and slidably mounted on top plate 24 through the use of a pair of spaced apart parallel slots 27*a* in alignment block 27 and thumb screws 31 that are screwed into top plate 24 once the horizontal carton alignment block 27 is properly positioned so as to facilitate longitudinal alignment of the carton with the stamp head assembly 72. A movable push bar 32 is slidably mounted on top plate 24 and includes a guiding structure (not shown) that interacts within parallel grooves 24*a* in top plate 24 so that movable push bar 32 may slide along grooves 24*a* to facilitate pushing the carton 15 towards the stamp head assembly 72**.

The revenue stamps (not shown) are carried on a roll that is rotatably mounted on revenue stamp feed mechanism 40. Feed mechanism 40 may be set up to either rotate to advance the reel of stamps a predetermined distance each time the stamp head assembly 72 returns to its initial position or to laterally index the stamps a predetermined number of times and then rotate to advance the stamps a predetermined distance. In either case, the revenue stamps are properly aligned and ready to be affixed to a carton 15 of cigarettes upon actuation of the revenue stamp application mechanism 60.

Programmable controller assembly 44 includes controls for providing electricity to revenue stamp application mechanism 60 upon sufficient movement of actuator trip plate 53 so that switch 46 is tripped. In addition, assembly 44 also provides the electricity and controls the timing of the revenue stamp feed mechanism 40 so that the revenue stamps are properly positioned prior to actuation of the revenue stamp application mechanism 60. Finally, assembly 44 also controls the length of time that solenoid 62 remains energized once switch 55 is actuated.

Actuator assembly 50 includes a pair of L-shaped actuator support arms 51 that are spaced apart and mounted on base plate 12. Each support arm 51 has a pair of apertures 51*a* extending therethrough and through which a pair of guide pins 52 secured to actuator trip plate 53 extend. A return spring 57 is positioned between each L-shaped actuator support arm 51 and actuator trip plate 53 with a guide pin 52 extending therethrough. A travel stop member 54 extends from each actuator support arm 51 and includes a post 54*a* and a resilient member 54*b* that engages actuator trip plate 53 as the actuator trip plate reaches the end of its sliding movement and actuates switch 55. Switch 55 is depicted as including a fixed non-contact proximity switch 55*a* and a movable proximity switch target 55*b* mounted on one of guide pins 52. Other types of switches could also be used. Actuator trip plate 53 includes a generally rectangular opening 53*a* dimensioned so as to be large enough to permit stamp head assembly 72 to pass therethrough in order to apply the revenue stamps to each pack of cigarettes but small enough so that the outer portions of the carton may engage the actuator trip plate 53 to affect linear movement thereof.

Revenue stamp application mechanism 60 includes a U-shaped base 61 mounted on base plate 12. Solenoid 62 is secured to U-shaped base 61 through L-shaped solenoid mounting block 63. A pair of slide guide blocks 64 are spaced apart and mounted on U-shaped base 61 on opposite sides of solenoid 62. The guide blocks 64 include linear bearings 65 through which guide shafts 66 extend to facilitate smooth linear motion of the guide shafts. Each guide shaft 66 is secured at one end to solenoid drive block 67 and at an opposite end to mounting bracket 71 that is secured to the stamp head assembly 72.

Stamp head assembly 72 is a multi-component assembly including a mounting plate 73 configured to be secured to mounting bracket 71. Stamp head assembly 72 further includes a heating assembly formed of a heating element (not shown) that is contained within a heater retainer 74 and an adjacent iron base 75 that functions as a thermal mass. A removable stamp iron 76 is secured to the iron base 75 and includes projections 76*a*, each being configured to align with one of the revenue stamps and a pack of cigarettes. The heating assembly of the heating element, heater retainer 74, iron base 75 and stamp iron 76 is generally thermally insulated from mounting plate 73 through an insulator 77 that is sandwiched between mounting plate 73 and heater retainer 74. As depicted, insulator 77 is formed of mechanical grade virgin Teflon, but may alternatively be made of any heat resistant material with low thermal conductivity.

Figure 4:
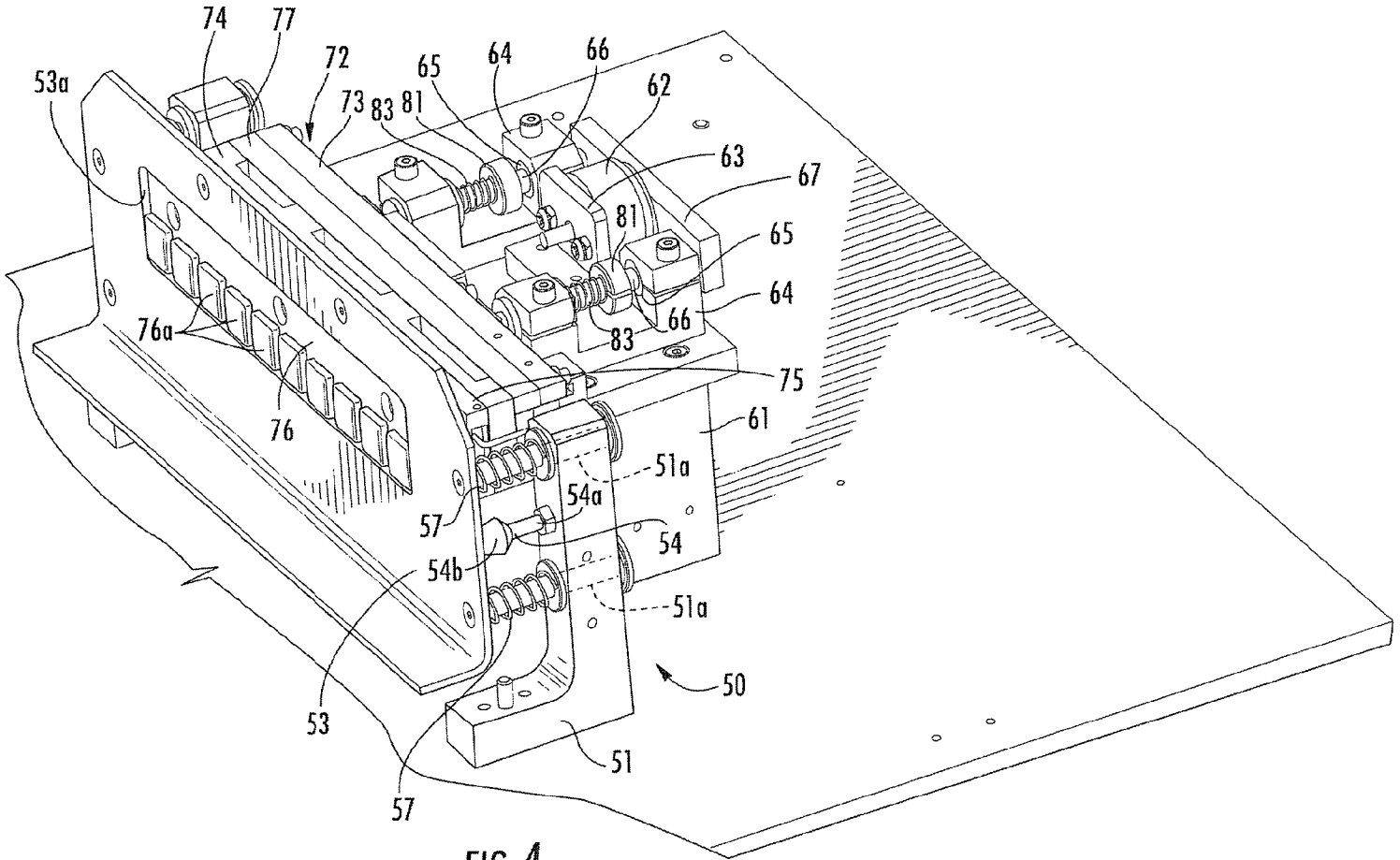
FIG. 4 is an enlarged perspective view of the actuator assembly and the revenue stamp application mechanism of FIG. 2.

It should be noted that in FIGS. 1 and 4, the stamp iron 76 has ten linearly aligned projections 76*a* and in FIGS. 2 and 5-7, the stamp iron 76 has five pairs of vertically aligned projections 76*a*. Accordingly, the stamp iron in FIGS. 1 and 4 is configured to apply stamps to cartons having packs arranged in a 1×10 configuration and the stamp iron in FIGS. 2 and 5-7 is configured to apply stamps to cartons having packs arranged in a 2×5 configuration. In practice, a stamp iron 76 is mounted on the stamp head assembly 72 and apparatus 10 operated until the operator desires to change the stamp iron to one of a different configuration. The alternate stamp irons are depicted herein merely to show alternate operative configurations.

Slide guide blocks 64 are generally U-shaped and include a pair of spaced apart linear bearings 65. Between the linear bearings is positioned a collar 81 secured to guide shaft 66 and a washer 82 spaced from the collar. A return spring 83 is positioned between collar 81 and washer 82 with guide shaft 66 extending through collar 81, washer 82 and return spring 83. Upon actuation of or energizing the solenoid 62, shaft 62*a* of the solenoid is pulled into the solenoid which moves the solenoid drive block 67 towards the carton 15 of cigarettes and likewise moves guide shafts 66 together with the entire stamp head assembly 72 towards the carton 15 and compresses return springs 83 between collars 81 and washers 82. Upon de-energizing solenoid 62, the return springs 83 provide sufficient force to move the entire slidable assembly (including the guide shafts 66, solenoid drive block 67, mounting bracket 71 and stamp head assembly 72) to the initial or loading position so that the stamp iron 76 is spaced from the carton 15 of cigarettes.

If desired, a hot glue station 84 may be positioned on base 12 adjacent carton positioning assembly 20. Hot glue station 84 includes a rectangular base or pedestal 85 with a glue station top plate 86 generally co-planar with planar section 25 of top plate 24 of carton positioning assembly 20 and generally acting as an extension thereof. A vertically upstanding glue station guide plate 87 is generally planar with vertically upstanding guide plate 26 of top plate 24 of carton positioning assembly 20 and generally acting as an extension thereof. A slot 86*a* is provided in glue station top plate 86 to permit hot glue contained in a reservoir (not shown) within base 85 to be applied to the flaps of a carton 15 of cigarettes after the tax stamps have been applied to the individual packs within the carton in order to facilitate re-sealing of the carton.

Figure 5:
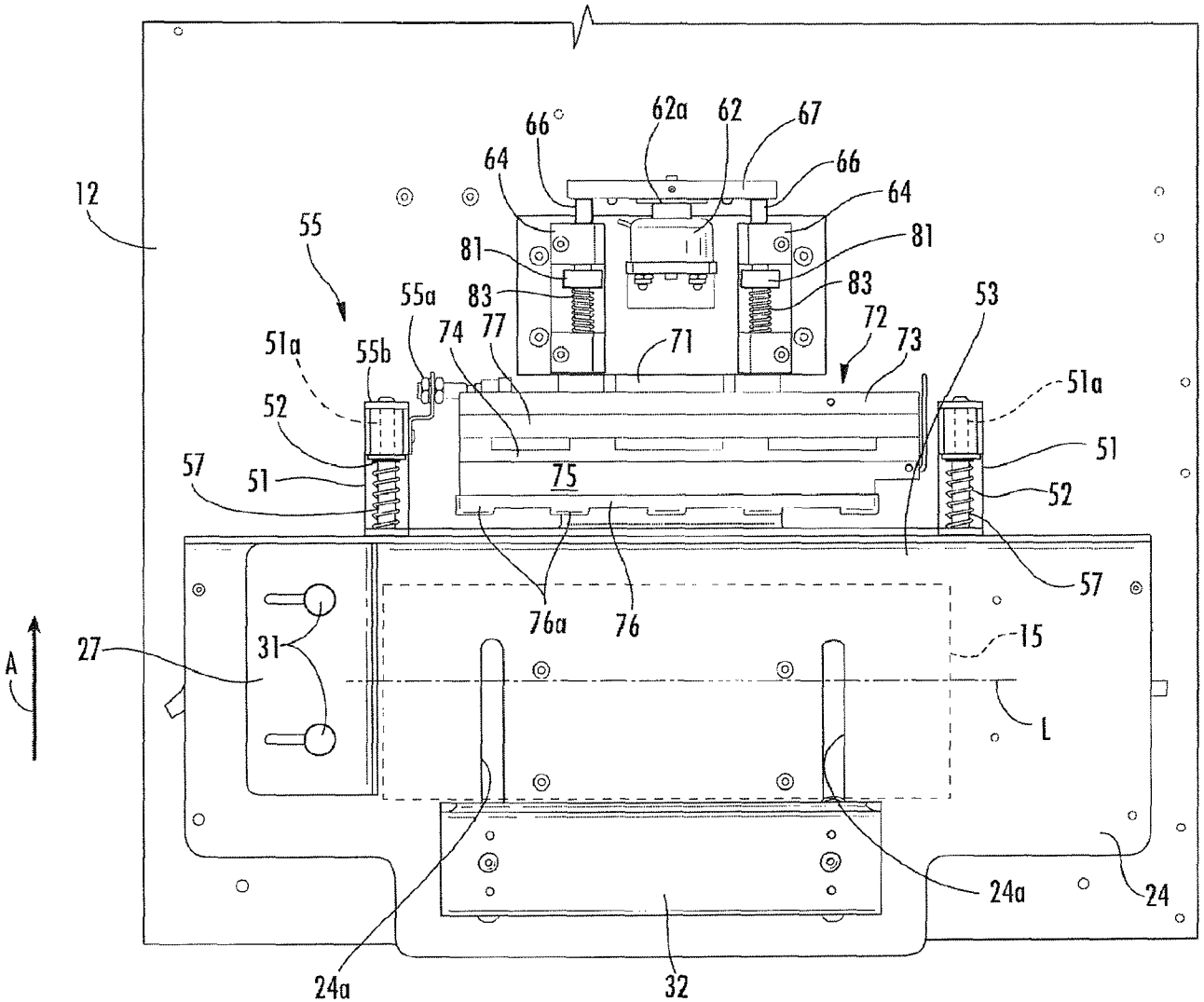
FIG. 5 is a top plan view of the carton positioning assembly, the actuator assembly and the revenue stamp application mechanism at a stamp application station with a carton of cigarettes positioned thereat and spaced from an actuator mechanism.
Figure 6:
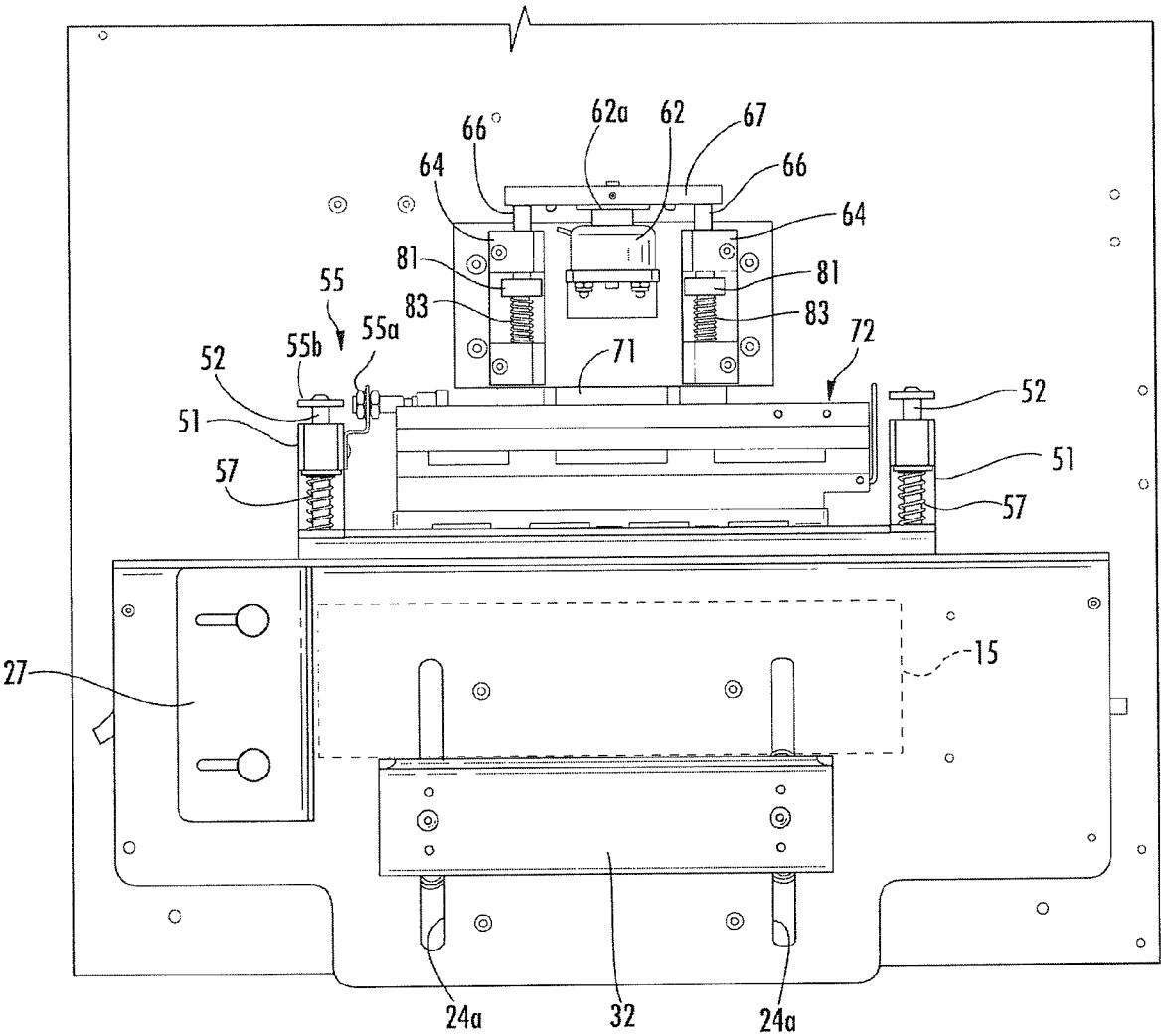
FIG. 6 is a top plan view similar to FIG. 5 but with the carton of cigarettes engaging the actuator mechanism but prior to energizing the solenoid and displacement of the stamp application head.
Figure 7:
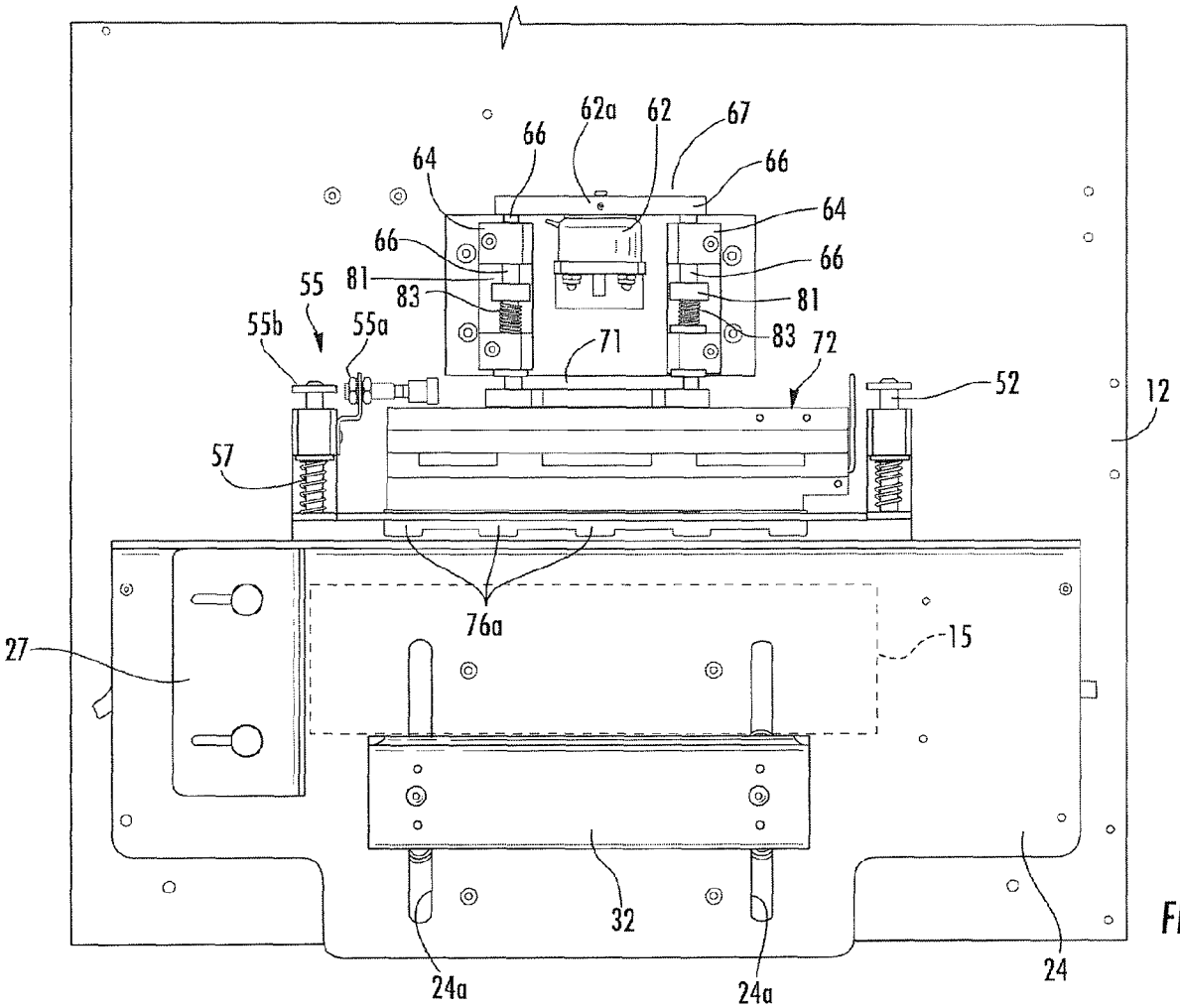
FIG. 7 is a top plan view similar to FIG. 6 but with the carton engaging the actuator mechanism and with the solenoid in its energized position in order to move the stamp application head into engagement with the packs of cigarettes.

In operation, a user places an open carton 15 of cigarettes on top of top plate 24 so that the open end of the carton is facing the stamp head assembly 72 and actuator trip plate 53. The operator slides the carton 15 so that it engages horizontal carton alignment block 27 in order to laterally position the carton along the longitudinal axis "L" of the carton relative to the revenue stamp applying apparatus 10 as shown in FIG. 5. In such position, actuator trip plate 53 is in its unengaged position as are solenoid 62 and stamp head assembly 72. The user then moves the carton of cigarettes towards the actuator trip plate 53 and the stamp head assembly 72 by pushing on movable push bar 32 in the direction of arrow "A" in FIG. 5. This moves the carton 15 of cigarettes laterally relative to longitudinal axis "L" and towards actuator trip plate 53 and stamp head assembly 72 as shown in FIG. 6. As the operator slides the carton 15 of cigarettes towards stamp head assembly 72, the carton slides through aperture 26*a* in guide plate 26 and engages actuator trip plate 53 to slide the actuator trip plate 53 towards solenoid 62, which compresses actuator return springs 54 as the carton approaches stamp iron 76. Once the actuator trip plate is moved from its disengaged position (FIG. 5) to its fully deflected position as shown in FIG. 6, proximity switch target 55*b* is close enough to proximity switch 55*a* in order to trigger switch 55 and send a signal to the programmable controller assembly 44 to carry out actuation of solenoid 62.

It has been determined that return guide springs 54 and the length of displacement of actuator trip plate 53 should be sized so that the force necessary to move actuator trip plate 53 from the disengaged position to its fully deflected position is approximately equal to or greater than the force provided by solenoid 62 in order to move stamp head assembly 72 into engagement with the carton of cigarettes. This configuration results in a high quality and repeatable transfer of revenue stamps to the packs of cigarettes without requiring significant skill on the part of each individual operator.

Once the actuator trip plate 53 moves to its fully deflected position and triggers switch 55, programmable controller assembly 44 sends a signal energizing solenoid 62 which retracts solenoid shaft 62*a* and moves guide shafts 66, solenoid drive block 67, mounting bracket 71 and stamp head assembly 72 into engagement with the revenue stamps and then into engagement with the individual packs of cigarettes in order to transfer the revenue stamps from their carrier to the cigarette packs. The programmable controller assembly 44 maintains solenoid 62 in an energized state for a predetermined period of time (typically 0.1 to 1.0 second depending on the details of the process used) and then de-energizes solenoid 62 and the return springs 83 apply a force on collars 81 in order to move guide shafts 66, solenoid drive block 67, mounting bracket 71 and stamp head assembly 72 away from the carton 15 to its original, de-energized position. The programmable controller assembly 44 then provides a signal to the revenue stamp feed mechanism 40 which either advances the roll of revenue stamps or laterally indexes the revenue stamps so that a new set of stamps is properly positioned and aligned with the stamp iron 76 so that the revenue stamp application apparatus 10 is ready to apply revenue stamps to the next carton of cigarettes.

Figure 8:
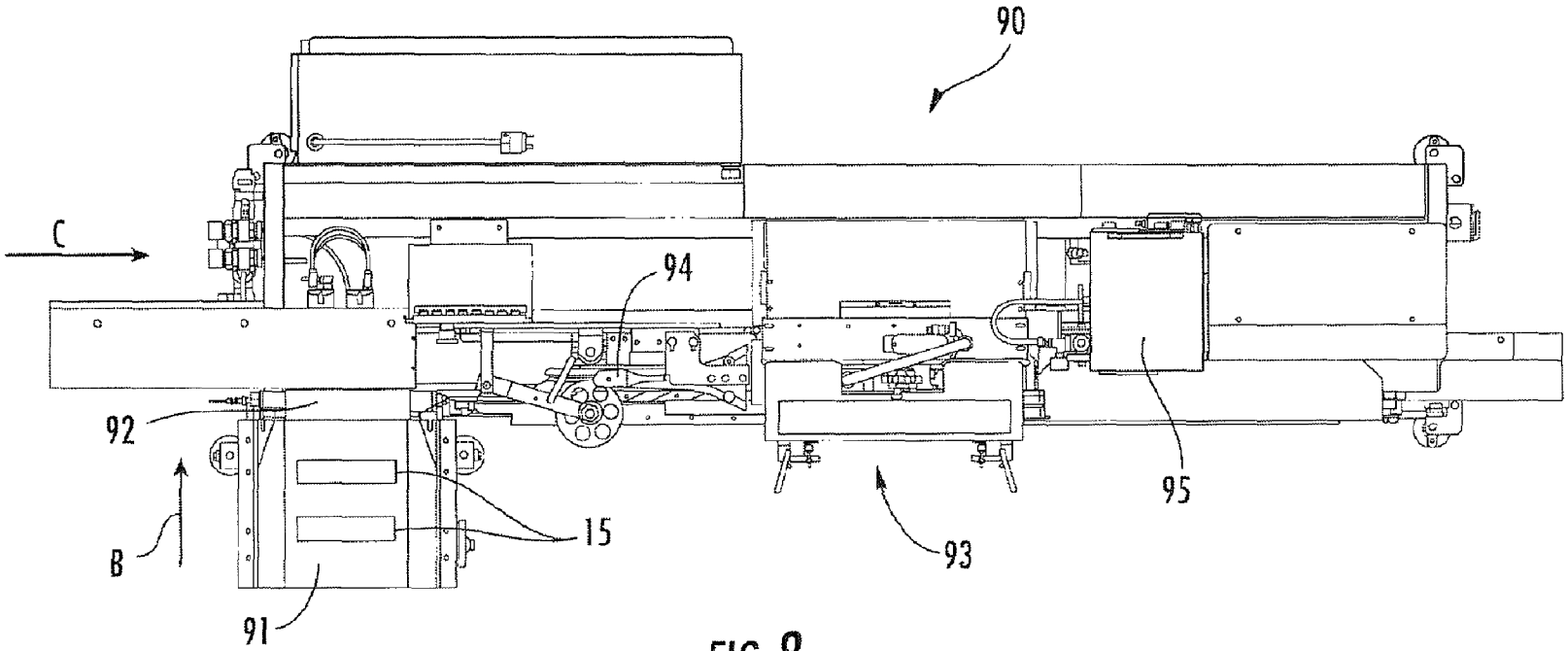
FIG. 8 is a top plan view of an automated revenue stamp applying system.

Although the revenue stamp application mechanism 60 is shown in connection with a manual application apparatus, the solenoid actuated application mechanism could also be utilized with an automated system 90 as depicted in FIG. 8. In such case, unopened cartons 15 are typically loaded onto a feed conveyor 91 and then moved laterally or perpendicular (in the direction of arrow "B") relative to the longitudinal axes of the cigarette cartons. Drive conveyor 92 is provided to move the cartons sequentially along a linear path (in the direction of arrow "C") from the feed conveyor 91 towards the revenue stamp application station 93 at which the revenue stamps are applied. Prior to reaching the application station 93, each carton is opened by a carton opening member 94. After opening each carton and applying revenue stamps to the cigarette packs, drive conveyor 92 moves each carton along linear path "C" to a glue station 95, which is located downstream from revenue stamp application station 93, to apply glue to each carton in order to re-seal the cartons after the revenue stamps have been applied. The re-sealed cartons are then removed from system 90 and may be returned to the boxes in which they were originally shipped or to some other boxes or containers as desired. The revenue stamp application station 93 would include a revenue stamp application apparatus similar to manual stamp application apparatus 60 and would also include components for automated sensing, triggering and alignment prior to the stamping operation.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

The invention claimed is:

1. An apparatus for applying labels to products comprising:

a base;

a label application station at which the labels may be applied;

an application head movably mounted on the base for movement between a first operative position spaced from a product positioned at the label application station and a second operative position at which the application head applies a label to the product positioned at the label application station;

a solenoid operatively connected to the application head to move the application head between the first and second operative positions;

an actuator mechanism to provide a triggering signal to an electricity source upon a triggering event to actuate the solenoid and move the application head from the first operative position to the second operative position; and a label feeding mechanism to provide a supply of labels for application to the products.

2. The apparatus of claim 1 wherein the actuator mechanism includes a switch and the switch is actuated upon engagement of the actuator mechanism by a force approximately equal to a force generated by actuation of the solenoid.

3. The apparatus of claim 2 wherein the actuator mechanism includes a movable trip plate configured to be engaged by the product to actuate the switch.

4. The apparatus of claim 1 wherein the actuator mechanism includes an electronic sensor for sensing a predetermined desired positioning of a product at the label application station.

5. The apparatus of claim 1 further including a drive structure interconnecting the application head and the solenoid, the drive structure being configured to guide the application head along a linear path between the first and second operative positions.

6. The apparatus of claim 5 wherein the drive structure includes a drive block operatively connected to the solenoid on a side of the solenoid opposite the application head and actuation of the solenoid moves the drive block towards the solenoid and the application head away from solenoid and towards the product located at the label application station.

7. The apparatus of claim 6 wherein the drive structure includes a pair of spaced apart guide shafts positioned on opposite sides of the solenoid for guiding the application head along the linear path, the guide shafts being operatively connected to the drive block and the application head.

8. The apparatus of claim 7 further including a pair of return springs for assisting in moving the application head from the second operative position to the first operative position, each return spring being concentrically positioned relative to one of the guide shafts.

9. The apparatus of claim 1 further including means for returning the application head from the second operative position to the first operative position.

10. The apparatus of claim 9 wherein the returning means includes at least one spring.

11. The apparatus of claim 1 wherein the label is applied to the product by applying heat to the label and pressure between the application head and the product.

12. The apparatus of claim 1 wherein the label feeding mechanism supplies labels to an operative position between the first and second operative positions of the application head.

13. The apparatus of claim 1 wherein the application head is configured to removably receive any of a plurality of differently configured removable application irons to permit labels to be applied to the product in different arrays.

14. An apparatus for applying labels to products comprising:

a base;

a label application station at which the labels may be applied to a product;

an application head movably mounted relative to the base for movement between a first operative loading position spaced from the label application station and a second operative application position at which the application head applies at least one label to a product positioned at the label application station;

an electrically actuated solenoid operatively connected to the application head to move the application head between the first and second operative positions;

a label feeding mechanism to provide a supply of labels for application to the products.

15. The apparatus of claim 14 further including an actuator mechanism to provide a triggering signal to an electricity source upon a triggering event to actuate the solenoid and move the application head from the first operative loading position to the second operative application position, and a switch, the switch being actuated upon engagement of the actuator mechanism by a force approximately equal to a force generated by actuation of the solenoid.

16. The apparatus of claim 15 wherein the actuator mechanism includes a movable trip plate configured to be engaged by the product to actuate the switch.

17. The apparatus of claim 14 further including a drive structure interconnecting the application head and the solenoid and configured to guide the application head along a linear path between the first and second operative positions, the drive structure including a pair of spaced apart guide shafts positioned on opposite sides of the solenoid for guiding the application head along the linear path.

* * * * *